US007108642B1

(12) United States Patent
Stearns

(10) Patent No.: US 7,108,642 B1
(45) Date of Patent: Sep. 19, 2006

(54) TORSO EXERCISE METHODS AND APPARATUS

(76) Inventor: Kenneth W. Stearns, P.O. Box 55912, Houston, TX (US) 77055

( * ) Notice: Subject to any disclaimer, the term of this patent is extended or adjusted under 35 U.S.C. 154(b) by 0 days.

(21) Appl. No.: 10/718,763

(22) Filed: Nov. 21, 2003

(51) Int. Cl.
*A63B 26/00* (2006.01)

(52) U.S. Cl. ..... 482/140; 482/121

(58) Field of Classification Search ..... 482/140–142, 482/148, 51, 92, 121–130, 907, 72; D21/676, D21/686, 690
See application file for complete search history.

(56) References Cited

U.S. PATENT DOCUMENTS 5,372,564 A * 12/1994 Spirito ..... 482/112
5,722,918 A * 3/1998 Lee ..... 482/72
6,752,745 B1 * 6/2004 Davis ..... 482/72

* cited by examiner

*Primary Examiner*—Lori Amerson

(57) ABSTRACT

An exercise device includes a frame, and upper and lower force receiving members movably mounted on the frame and constrained to pivot in opposite directions. A resistance device is preferably interconnected between the frame and at least one of the force receiving members to resist movement of the members toward one another and/or to bias the members away from one another. The lower member is configured to support a person's feet, and the upper member is configured to support a person's hands and/or to engage a person's chest. The device facilitates a combination crunch and leg lift exercise that involves both a person's upper abdominal muscles and a person's lower abdominal muscles. The device may be operated in a manner that facilitates exercise of a person's oblique muscles, as well.

9 Claims, 8 Drawing Sheets

TORSO EXERCISE METHODS AND APPARATUS

FIELD OF THE INVENTION

The present invention relates to exercise equipment, and in particular, to torso exercise methods and apparatus.

BACKGROUND OF THE INVENTION

Various exercise devices have been developed to exercise various muscles of the human body, including a person's torso muscles. Many prior art devices primarily work only a person's upper abdominal muscles or a person's lower abdominal muscles. Other prior art devices effectively work both, and some such devices work a person's oblique muscles, as well. Generally speaking, the combination devices are either relatively complicated or relatively ineffective. In another words, a need remains for a relatively simple, yet thoroughly effective torso exercise device.

SUMMARY OF THE INVENTION

The present invention provides exercise apparatus suitable for exercise of a person's torso muscles. A preferred embodiment of the present invention includes a seat mounted on a frame, an upper body support movably connected to the frame, and a lower body support movably connected to the frame and constrained to move upward in response to downward movement of the upper body support. Many of the features and advantages of the present invention will become apparent to those skilled in the art from the more detailed description that follows.

BRIEF DESCRIPTION OF THE FIGURES OF THE DRAWING

With reference to the Figures of the Drawing, wherein like numerals designate like parts and assemblies throughout the several views.

DETAILED DESCRIPTION OF A PREFERRED EMBODIMENT

Figure 1:
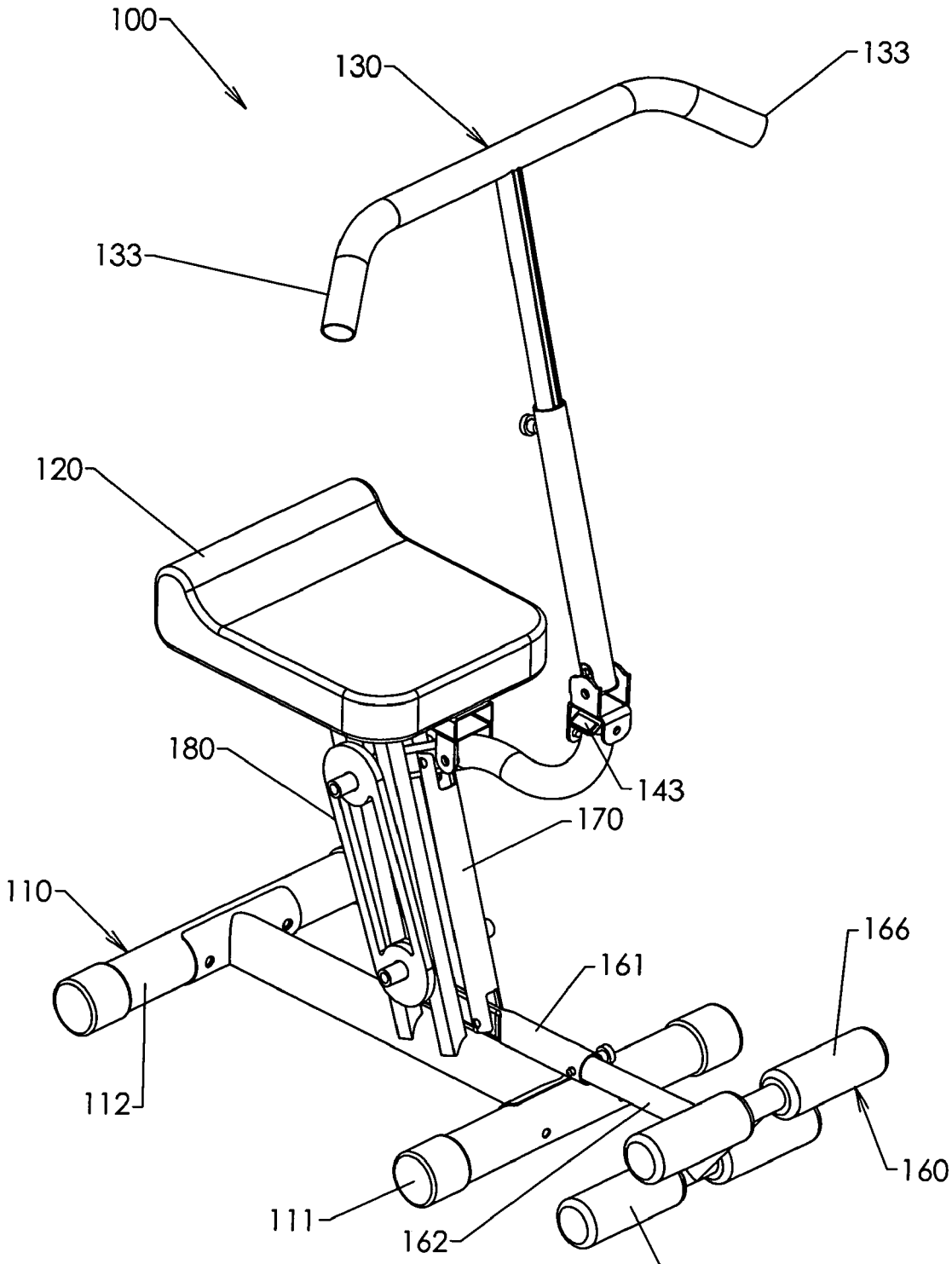
FIG. 1 is a perspective view of a preferred embodiment exercise device constructed according to the principles of the present invention.
Figure 2:
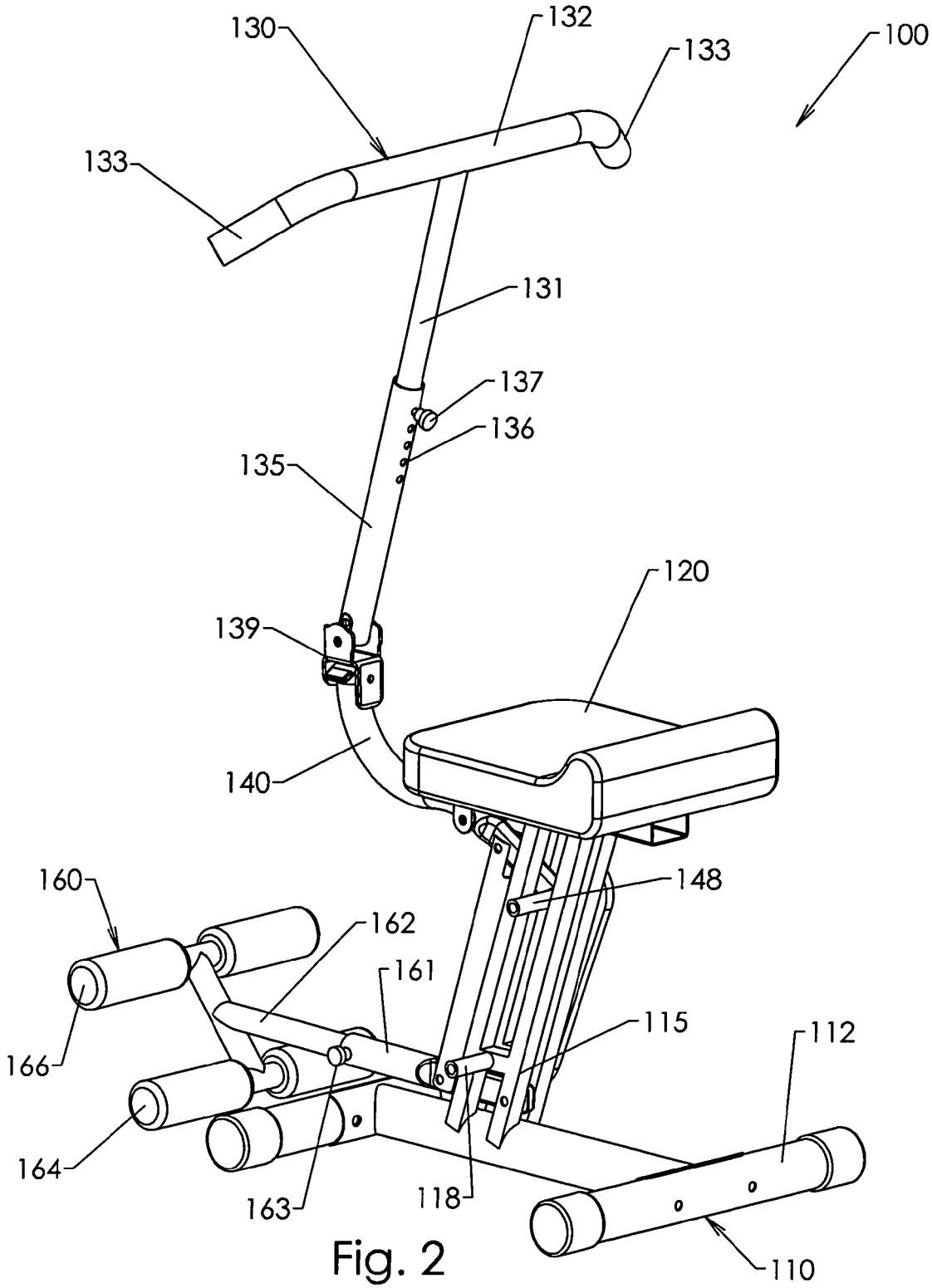
FIG. 2 is another perspective view of the exercise device of FIG. 1.
Figure 3:
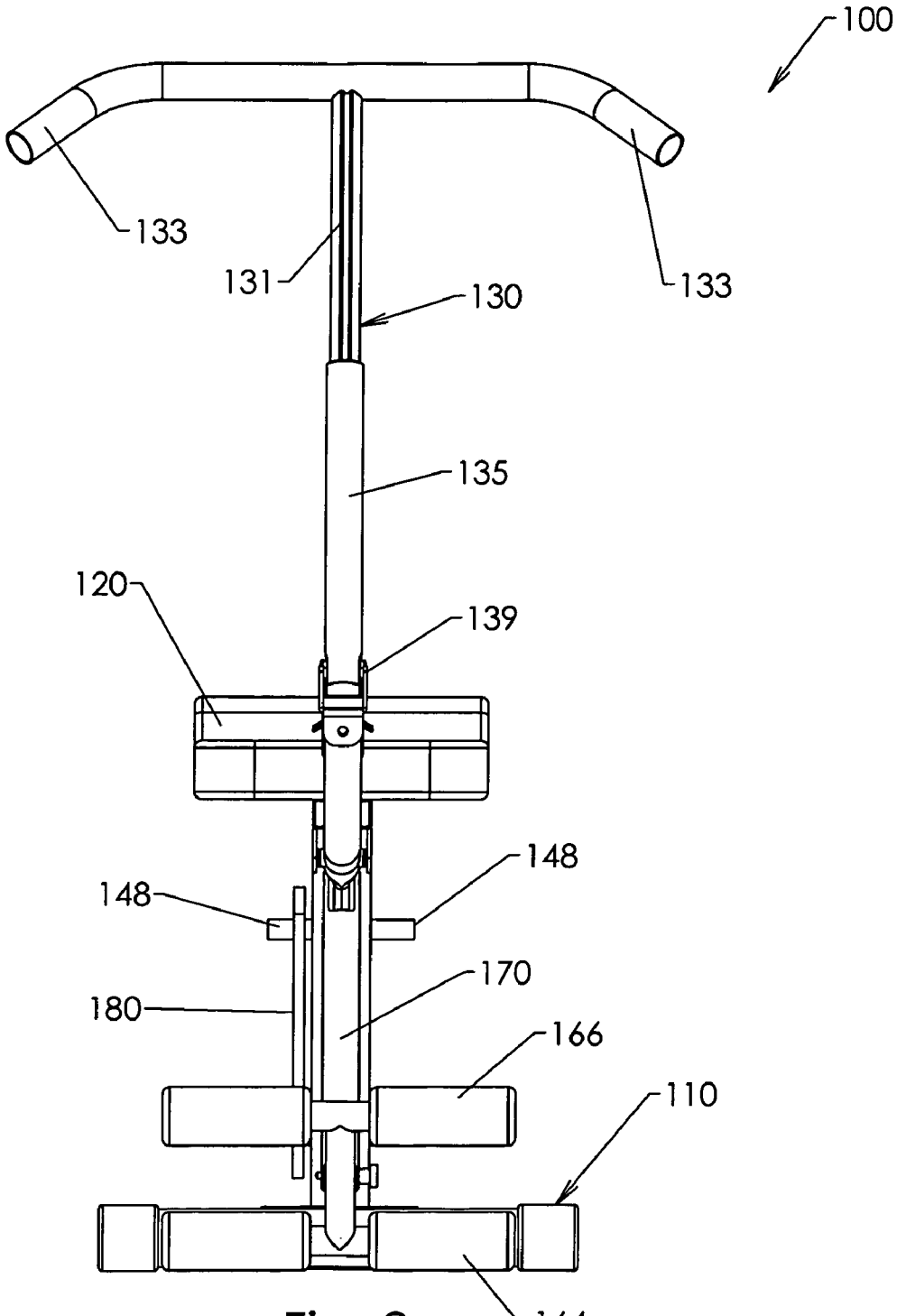
FIG. 3 is a front view of the exercise device of FIG. 1.
Figure 4:
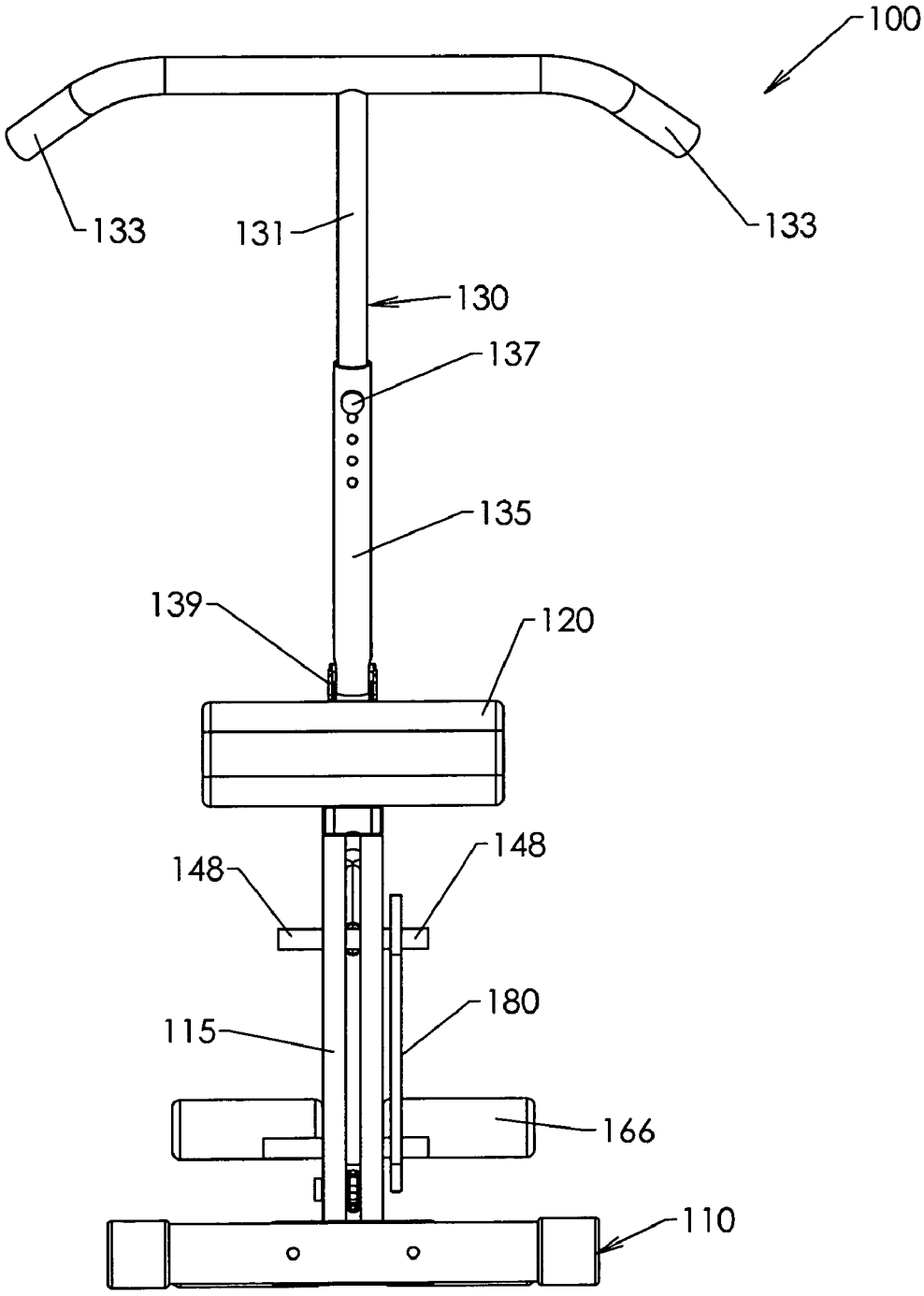
FIG. 4 is a back view of the exercise device of FIG. 1.

A preferred embodiment exercise device constructed according to the principles of the present invention is designated as 100 in FIGS. 1–8. The device 100 may be described generally in terms of a frame 110 designed to rest on a floor surface, a seat 120 mounted on the frame 110, an upper body support 130 movably mounted on the frame 110, a lower body support 160 movably mounted on the frame 110, and a linkage interconnected between the supports 130 and 160 to constrain the supports to move in opposite directions.

The frame 110 may take various forms and/or be made in various manners. On the preferred embodiment 100, the frame 110 includes a floor engaging base that is I-shaped and extends from a forward end 111 to a rearward end 112. An intermediate stanchion 115 is rigidly connected to an intermediate portion of the base, and extends upward and rearward from the base. On the preferred embodiment 100, the stanchion 115 comprises four bars that define gaps therebetween.

Figure 7:
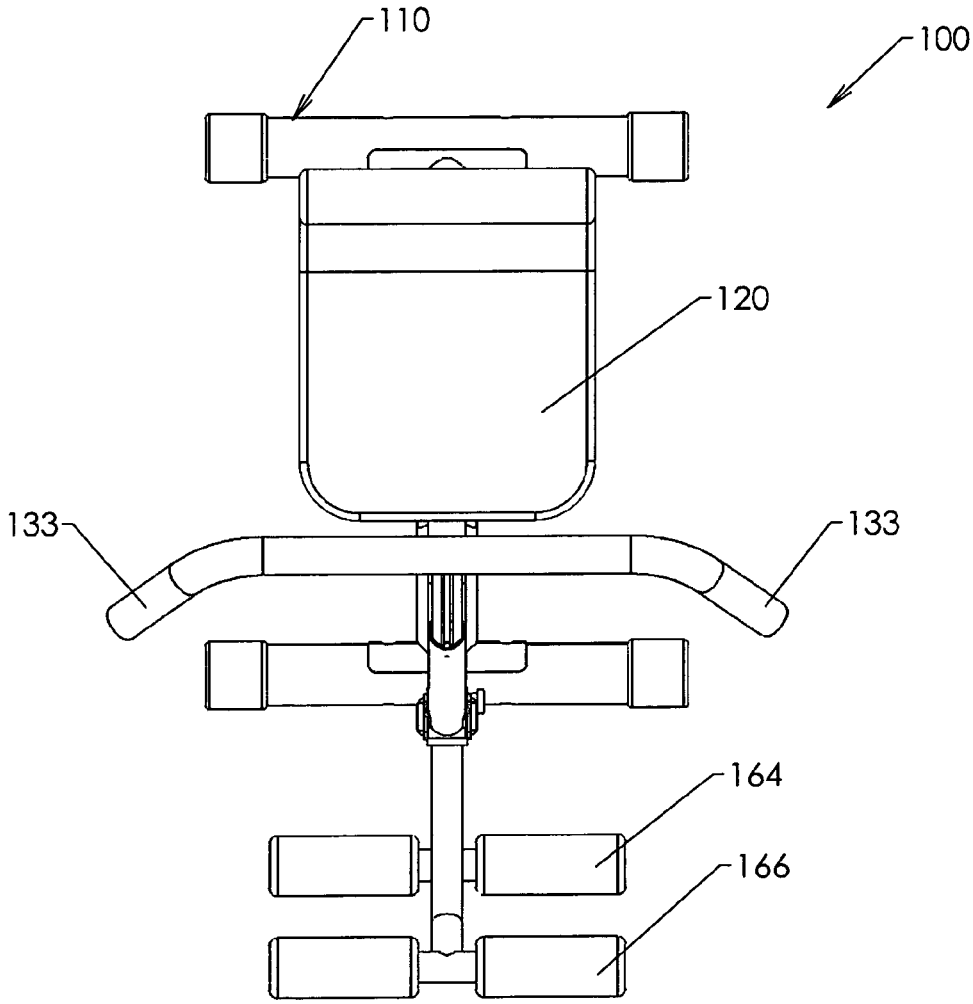
FIG. 7 is a top view of the exercise device of FIG. 1.
Figure 8:
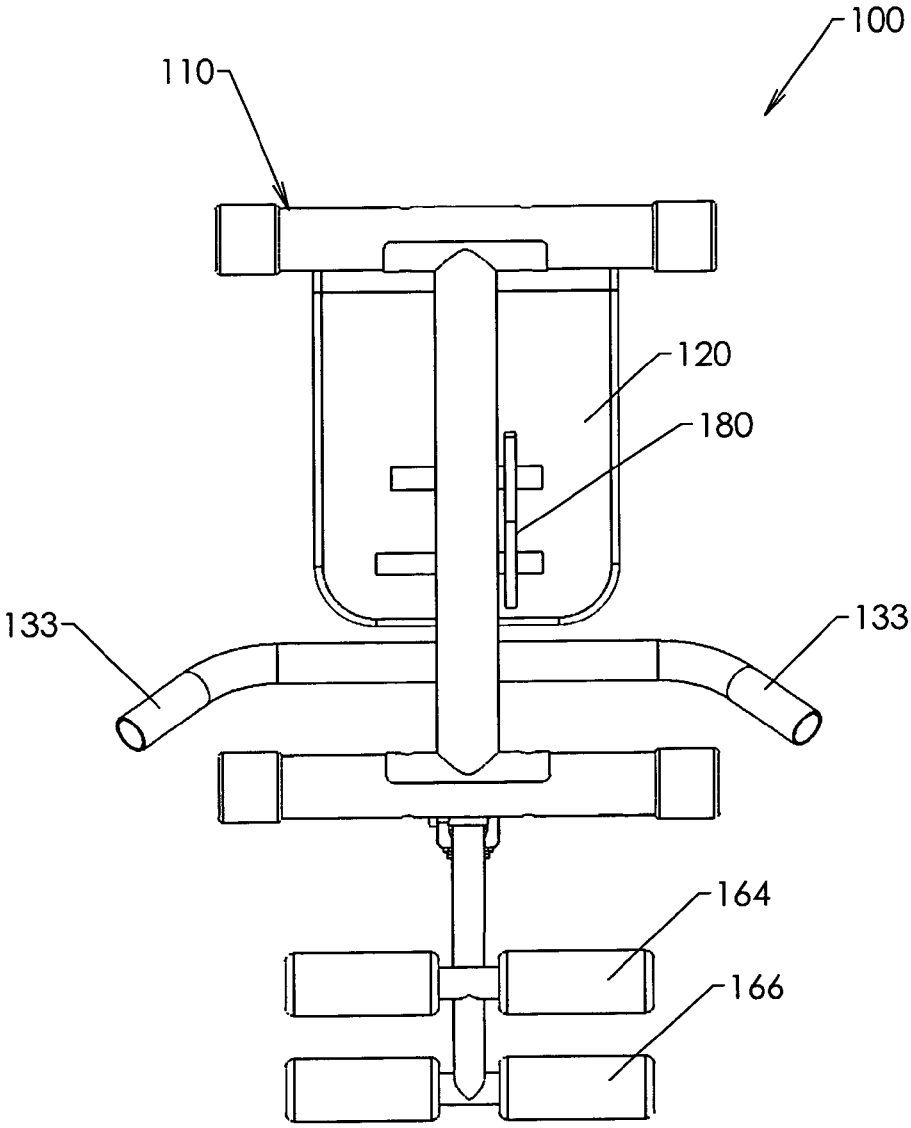
FIG. 8 is a bottom view of the exercise device of FIG. 1.

The seat 120 is rigidly mounted on top of the stanchion 115. The seat 120 preferably includes a covered padded portion and an underlying support structure. A trunnion 124 is mounted beneath the forward end of the seat 120 for reasons discussed below. On the preferred embodiment 100, an upwardly extending back support is provided along the rear edge of the seat 120. Among other things, the seat 120 may be described as sized and configured to support a person in a seated position above an underlying floor surface. FIG. 7 shows a top view of the apparatus 100, and illustrates to what extent other components are disposed beneath the planform defined by the seat 120.

A curved bar 140 has an intermediate portion that is pivotally connected to the trunnion 124, thereby defining a pivot axis X (labeled in FIG. 5) that extends beneath the planform defined by the seat 120. The bar 140 is configured and arranged in such a manner that a forward end of the bar 140 is disposed in front of the seat 120. A universal joint bracket 139 is mounted on the forward end of the bar 140, thereby defining a lower, "fore-to-aft" pivot axis and an upper, "side-to-side" pivot axis. The bracket 139 pivots side-to-side about the lower axis relative to the bar 140. As shown in FIG. 1, tabs 143 project outward from opposite sides of the bracket 139 to limit pivoting of the bracket 139 relative to the bar 140.

Figure 5:
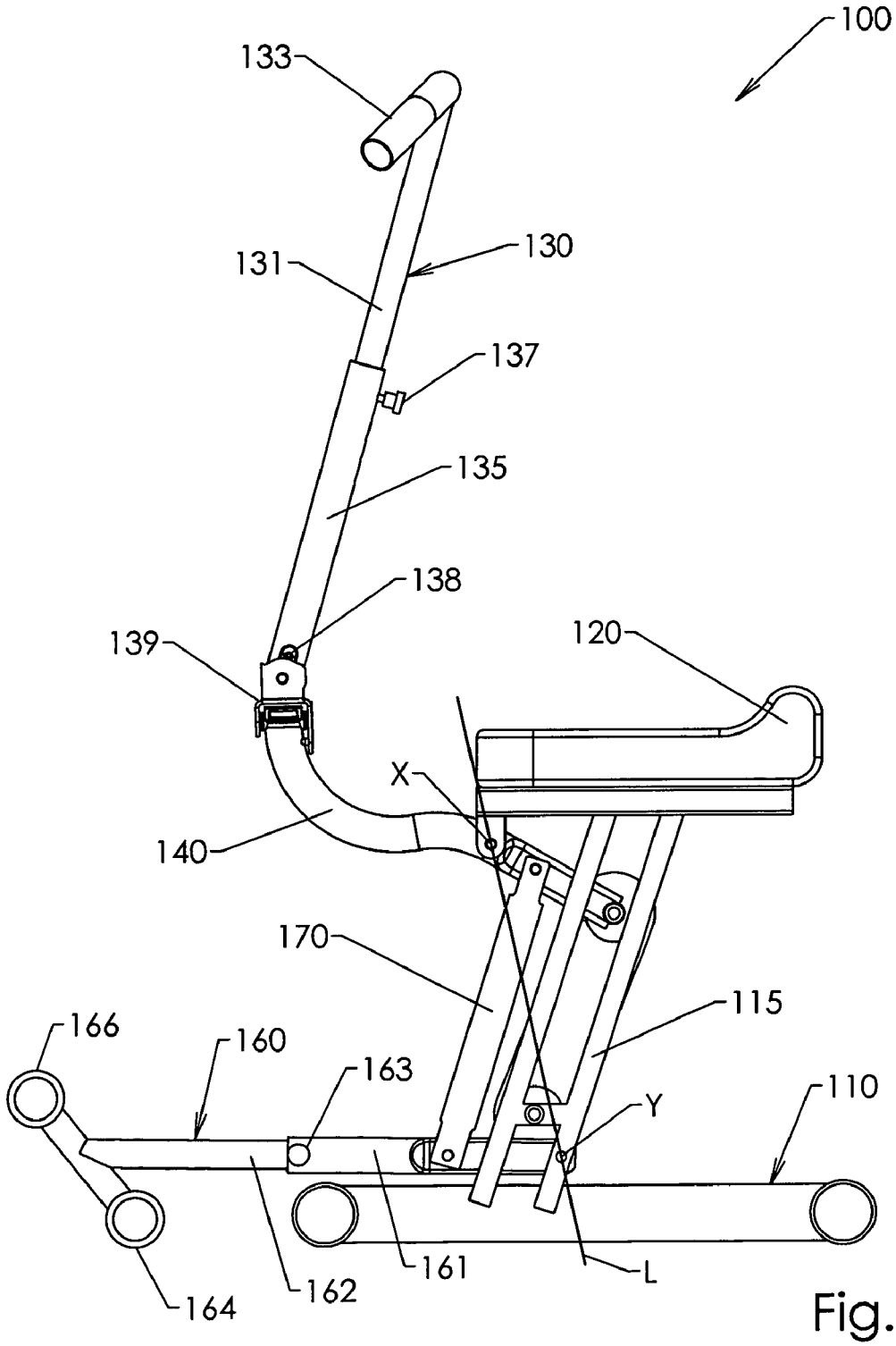
FIG. 5 is a side view of the exercise device of FIG. 1.
Figure 6:
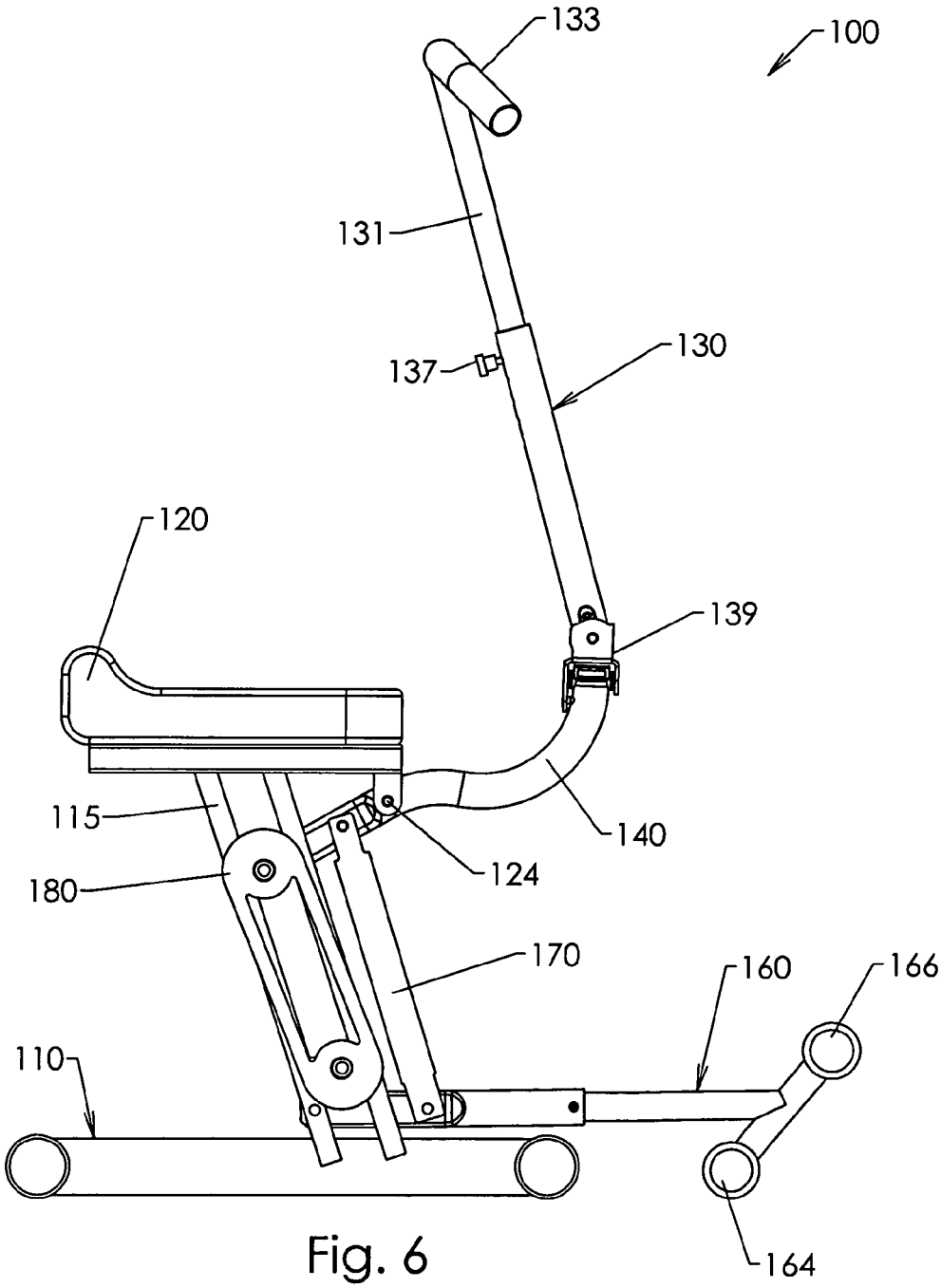
FIG. 6 is an opposite side view of the exercise device of FIG. 1.

A tube 135 has a lower end pivotally connected to the bracket 139 at the upper pivot axis. As a result, the tube 135 pivots fore-and-aft relative to the bracket 139, and side-to-side together with the bracket 139. As shown in FIG. 5, pegs 138 project outward from opposite sides of the tube 135 and cooperate with the bracket 139 to limit pivoting of the tube 135 relative to the bracket 139. A sleeve or bellows (not shown) is preferably disposed about the universal joint both for aesthetic purposes and to cover potential pinch points.

A bar 131 has a lower end that is telescopically mounted inside the tube 135. As suggested by FIGS. 1 and 3, the bar 131 is also preferable keyed to the tube 135 to prevent relative rotation therebetween. In this regard, a nub on the tube 135 projects into a groove extending along the bar 131. As a result of the key arrangement, a hole in the bar 131 aligns with any one of a series of holes 136 in the tube 135 to receive a ball-detent pin 137 or other suitable fastener.

A cross-bar 132 has an intermediate portion that is rigidly mounted on the upper end of the bar 131. Opposite ends 133 of the cross-bar 132 are angled downward and forward, and may be described as hand grips that are sized and configured for grasping. The members 131, 132, and 140 may be collectively described as a handlebar or an upper body support 130.

The upper body support 130 is configured and arranged to place the hand grips 133 within comfortable reach of an average adult person sitting on the seat 120, and to place the center of the cross-bar 132 proximate the person's chest. A chest pad may be mounted on the intermediate portion of the cross-bar 132 to provide a comfortable bearing member for the person's chest. Moreover, in order to accommodate people with different heights and/or reaches, the fastener 137 and associated holes allow the cross-bar 132 and associated hand grips 133 to be adjusted upward and downward, and the upper pivot axis on the universal joint bracket 139 allows the cross-bar 132 and associated hand grips 133 to be pivoted fore and aft.

An intermediate portion of the bar 140, disposed rearward of the trunnion 124, is pivotally connected to the upper end of a link 170. An opposite, lower end of the link 170 is pivotally connected to an intermediate portion of a tube 161. A rearward end of the tube 161 is pivotally connected to the stanchion 115, thereby defining a pivot axis Y (labeled in FIG. 5) that extends beneath the planform defined by the seat 120. The bar 140 is arranged to intersect or cross over a line L (shown in FIG. 5) drawn perpendicularly through both the pivot axis Y and the pivot axis X.

A bar 162 has a rearward end that is mounted inside a forward end of the tube 161. In a manner similar to the bar 131, the bar 162 may be telescopically mounted inside the tube 161, keyed relative to the tube 161, and adjusted relative to the tube 161 by means of a ball-detent pin 163 inserted through a hole in the tube 161 any one of a series of holes in the bar 162. In the alternative, the bar 162 may simply be bolted to the tube 161 or connected via a hinge.

A foot supporting assembly is mounted on a forward end of the bar 162. The assembly may be described as a "sideways" H, with the center of the H rigidly connected to the bar 162. Left and right lower foot members 164 extend in respective directions away from the center of the H. The members 164 are sized and configured to support a person's feet, and are preferably padded by foam tubes or other suitable means. Left and right upper foot members 166 extend in respective directions away from the center of the H. The members 166 are similarly padded, and are sized and configured to overlie a person's feet. The members 164 and 166 cooperate with the bar 162 and the tube 161 to define a lower body support 160 that can receive both pushing and pulling forces exerted through a person's feet. In a first mode of operation, a person sits on the seat 120 with his legs straddling the upper body support 130, and places his feet on respective sides of the lower body support 160.

The link 170 constrains the lower body support 160 and the upper body support 130 to pivot in opposite directions relative to the frame 110. For example, downward movement of the upper body support 130 causes upward movement of the lower body support 160, and upward movement of the lower body support causes downward movement of the upper body support 130. In the absence of a dedicated resistance device, these movements may be performed on the apparatus 100 subject to the force of gravity acting on the mass of the user's legs.

The preferred embodiment 100 is also provided with structure to accommodate additional resistance or biasing means in the form of at least one elastic band 180. This type of resistance band 180 is well known in the art and used on other types of exercise equipment, and those skilled in the art will also recognize that different types of resistance devices (e.g. springs, elastic cords, hydraulic cylinders, gas springs, weights, and the like) may be substituted for the bands 180 without departing from the scope of the present invention.

The resistance band 180 is releasably mounted on the apparatus 100 by means of pegs 118 and 148. In this regard, left and right pegs 118 are rigidly secured to the frame 110, and project outward from respective sides of the stanchion 115 just above the floor engaging base. Also, left and right pegs 148 are rigidly secured to a rearward end of the bar 140, and project outward from respective sides of the bar 140. The bar 140 projects rearward through a gap in the stanchion 115 to meet the pegs 148, which project laterally through opposite side gaps in the stanchion 115.

Each peg 118 and 148 is configured to fit into a hole in a respective end of the elastic band(s) 180. Means may be provided on the pegs 118 and 148 and/or the band(s) 180 to help secure the band(s) in place on the pegs. Furthermore, the pegs 118 and 148 may be spaced in such a manner that the band(s) 180 are always in tension when mounted on the pegs. Each band 180 mounted on the pegs 118 and 148 will resist downward movement of the upper body support 130 and thus, upward movement of the lower body support 160, as well.

The present invention facilitates exercise of a person's upper abdominal muscles (by user force exerted downward against the hand grips 133 and/or a pad on the cross-bar 132), and exercise of a person's lower abdominal muscles (by user force exerted upward against the foot members 166). The present invention also encourages contemporaneous exercise of all of the abdominal muscles by coordinating movement of the upper and lower force receiving members 130 and 160.

The present invention also facilitates exercise of a person's oblique muscles (by movement of the force receiving members 130 and 160 while the user occupies a "twisted" position on the apparatus 100). In alternative modes of operation, exercise of the oblique muscles may be achieved by turning to either side on the seat 120, lifting upward with one's feet while both feet are positioned on one side of the lower body member 160, and/or pushing downward on the upper body member 130 while displacing it laterally, as well.

The present invention has been described with reference to a preferred embodiment and a specific application. However, this disclosure will also enable persons skilled in the art to recognize additional embodiments and/or applications that incorporate the essence of the present invention. Among other things, various parts of the present invention may be provided in different shapes or arrangements to change the appearance of the apparatus. Also, any of various shrouds may be mounted beneath the seat and about the stanchion and proximate parts to improve the appearance of the apparatus and/or cover potential pinch points. Any such shroud may be provided with an opening or door to provide access to the resistance device, if any, that is included on the apparatus. In any event, the scope of the present invention is to be limited only to the extent of the following claims.

What is claimed is:

1. An exercise apparatus, comprising:

a frame configured to rest on a floor surface;

a seat mounted on a first portion of the frame;

an upper body support pivotally mounted on a discrete, second portion of the frame, wherein the upper body support and the frame cooperate to define a first pivot axis, and the upper body support is configured and arranged to extend generally vertically upward in front of the seat;

a lower body support pivotally mounted on a discrete, third portion of the frame, wherein the lower body support and the frame cooperate to define a discrete, second pivot axis, and the lower body support is configured and arranged to extend generally horizontally outward beneath the upper body support and forward of the seat; and a constraining means, interconnected between the lower body support and the upper body support, for constraining the upper body support and the lower body support to pivot toward one another, and in respective, opposite directions relative to both the frame and the seat; and a resisting means, interconnected between the frame and the upper body support, for resisting downward movement of the upper body support relative to the frame; and wherein the second frame portion is disposed beneath a planform defined by the seat, and the third frame portion is disposed beneath the planform defined by the seat.

2. The exercise apparatus of claim 1, wherein the lower body support includes a bar that extends forward of the seat, and left and right lower foot members configured to support a person's feet, and left and right upper foot members configured to overlie the person's feet when resting on the lower foot members.

3. The exercise apparatus of claim 1, wherein the upper body support includes a first bar that extends upward in front of the seat, a second bar having opposite, distal ends that define respective left and right hand grips, and a universal joint interconnected between the first bar and the second bar.

4. The exercise apparatus of claim 1, wherein the seat is rigidly secured in place on the first portion of the frame.

5. The exercise apparatus of claim 1, further comprising a resisting means, interconnected between the frame and the upper body support, for resisting downward movement of the upper body support relative to the frame.

6. The exercise apparatus of claim 5, wherein the resisting means is interconnected between a portion of the upper body support that is disposed beneath a planform defined by the seat, and a portion of the frame that is disposed beneath the planform defined by the seat.

7. The exercise apparatus of claim 1, wherein the second frame portion is disposed beneath a planform defined by the seat, and the third frame portion is disposed beneath the planform defined by the seat.

8. The exercise apparatus of claim 1, wherein the upper body support is configured and arranged to be centered transversely relative to the seat, and to accommodate a person's legs on opposite sides thereof.

9. An exercise apparatus, comprising:

a frame configured to rest on a floor surface;

a seat mounted on a first portion of the frame;

an upper body support pivotally mounted on a discrete, second portion of the frame, wherein the upper body support and the frame cooperate to define a first pivot axis, and the upper body support is configured and arranged to extend generally vertically upward in front of the seat;

a lower body support pivotally mounted on a discrete, third portion of the frame, wherein the lower body support and the frame cooperate to define a discrete, second pivot axis, and the lower body support is configured and arranged to extend generally horizontally outward beneath the upper body support and forward of the seat; and a constraining means, interconnected between the lower body support and the upper body support, for constraining the upper body support and the lower body support to pivot toward one another, and in respective, opposite directions relative to both the frame and the seat, wherein the seat is rigidly secured in place on the first portion of the frame; and resisting means, interconnected between the frame and the upper body support, for resisting downward movement of the upper body support relative to the frame.

* * * * *